US009502826B1

(12) United States Patent
Young et al.

(10) Patent No.: US 9,502,826 B1
(45) Date of Patent: Nov. 22, 2016

(54) ELECTRICAL CONNECTOR ASSEMBLY HAVING A PLUG WITH A FIRST SHIELDING HOUSING AND A SOCKET WITH A SECOND SHIELDING HOUSING

(71) Applicant: SPEED TECH CORP., Taoyuan (TW)

(72) Inventors: James Patrick Young, Taoyuan (TW); Kuo-Hua Huang, Taoyuan (TW)

(73) Assignee: SPEED TECH CORP., Taoyuan (TW)

( * ) Notice: Subject to any disclaimer, the term of this patent is extended or adjusted under 35 U.S.C. 154(b) by 0 days.

(21) Appl. No.: 15/095,169

(22) Filed: Apr. 11, 2016

(30) Foreign Application Priority Data

Jun. 17, 2015 (TW) ..... 104209934 U

(51) Int. Cl.
*H01R 13/648* (2006.01)
*H01R 13/6461* (2011.01)
*H01R 13/6581* (2011.01)
*H01R 13/658* (2011.01)

(52) U.S. Cl.
CPC ..... *H01R 13/6461* (2013.01); *H01R 13/6581* (2013.01); *H01R 13/65802* (2013.01)

(58) Field of Classification Search
CPC ..... H01R 13/648; H01R 13/658; H01R 13/65802; H01R 13/6593
USPC ..... 439/607.27, 607.01–607.54
See application file for complete search history.

(56) References Cited

U.S. PATENT DOCUMENTS 6,139,367 A * 10/2000 Yeh ..... H01R 13/65802 439/607.17
7,537,488 B2 * 5/2009 Iwakawa ..... H01R 13/22 439/660
7,922,534 B2 * 4/2011 Lin ..... H01R 13/64 439/544
2002/0142636 A1 * 10/2002 Murr ..... H01R 13/65802 439/108
2004/0229482 A1 * 11/2004 Zhu ..... H01R 23/6873 439/79

FOREIGN PATENT DOCUMENTS

TW M485551 U 9/2014

* cited by examiner

*Primary Examiner* — Chandrika Prasad
(74) *Attorney, Agent, or Firm* — CKC & Partners Co., Ltd.

(57) ABSTRACT

An electrical connector assembly includes a plug connector and a socket connector. The plug connector includes an insulator body, a first shielding housing and a shielding member, wherein the first shielding housing encloses the insulator body, the shielding member has first contact portions and second contact portions, and the first contact portions are electrically connected with the first shielding housing. The socket connector is configured to be electrically connected with the plug connector, and the socket connector has a second shielding housing configured to be electrically connected with the second contact portions.

9 Claims, 9 Drawing Sheets

ELECTRICAL CONNECTOR ASSEMBLY HAVING A PLUG WITH A FIRST SHIELDING HOUSING AND A SOCKET WITH A SECOND SHIELDING HOUSING

RELATED APPLICATIONS

This application claims priority to Taiwanese Application Serial Number 104209934, filed Jun. 17, 2015, which are herein incorporated by reference.

BACKGROUND

Field of Invention

The present invention relates to an electrical connector assembly, and particularly relates to an electrical connector assembly of a plug connector and a socket connector.

Description of Related Art

Since most electronic devices continue to increase their data transmission amount, the majority of electronic devices also increase their signal transmitting rates in order to provide a more user-friendly experience. In order to allow users to transfer large amounts of electronic data in an even shorter time, the current way is to enhance signal-transmitting frequency between electronic devices in addition to increasing more channels for transmitting electrical signals. However, the high-frequency electrical signals may easily cause cross talks due to a small-volume electronic device trend so as to generate high-frequency noises. Therefore, in this ever-increasing frequency of electronic signals transferring between different electronic devices, the adverse effects of high-frequency electronic signals should be considered in the connector design, and the disadvantages of high frequency signals should be properly controlled to reduce its impact such that high-frequency electrical signals can be properly transferred between electronic devices.

A general way to isolate EMI cross talks between inner signals and outer signals of an electrical connector is using an metallic housing as an isolation wall, and grounding the inner noises within the electrical connector so as to reduce adverse effects of the noises. FIG. 1 illustrates a perspective view of a conventional electrical connector disclosed in Taiwanese Patent Serial Number M485551. The conventional electrical connector includes a cable A, a release member B, a circuit board C, a latch D and a housing E. In such disclosure, the cable A is installed into the housing E and electrically connected with the circuit board C. The release member B is assembled to the housing E and is movable along with the latch D. When the electrical connector is interconnected with a counter-part connector, the release member B is exercised along with the latch D to detach the electrical connector from its counter-part connector. However, in such a design, the wide variety of parts cause a complex manufacturing process and cross talks during transferring electronic signals between different electronic devices. Therefore, it is necessary to improve such electrical connector design.

SUMMARY

An aspect of this invention provides an electrical connector assembly of a plug connector and a socket connector so as to maintain a high-frequency signal transmission quality.

According to one or more embodiments of this invention, an electrical connector assembly includes a plug connector and a socket connector. The plug connector includes an insulator body, a first shielding housing and a shielding member, wherein the first shielding housing encloses the insulator body, the shielding member has first contact portions and second contact portions, and the first contact portions are electrically connected with the first shielding housing. The socket connector is configured to be electrically connected with the plug connector, and the socket connector has a second shielding housing configured to be electrically connected with the second contact portions.

According to one or more embodiments of this invention, the plug connector has a signal-transmitting module, part of which is embedded within the insulator body, and the insulator body is disposed between the signal-transmitting module and the first shielding housing to achieve electrical isolation.

According to one or more embodiments of this invention, the shielding member secured to the insulator body, and the shielding member is disposed between the first shielding housing and the signal-transmitting module, the first shielding housing has through holes configured to allow the second contact portions of the shielding member to protrude out.

According to one or more embodiments of this invention, the shielding member is made from a bent metal sheet.

According to one or more embodiments of this invention, the shielding member consists of multiple assembled sub-shielding members.

According to one or more embodiments of this invention, the shielding member is a hollow metal frame.

According to one or more embodiments of this invention, the first contact portions are resilient arms.

According to one or more embodiments of this invention, the first contact portions are protrusion bumps.

According to one or more embodiments of this invention, the second contact portions are resilient arms.

It is to be understood that both the foregoing general description and the following detailed description are by examples, and are intended to provide further explanation of the disclosure as claimed.

BRIEF DESCRIPTION OF THE DRAWINGS

The disclosure can be more fully understood by reading the following detailed description of the embodiment, with reference made to the accompanying drawings as follows.

DETAILED DESCRIPTION

Figure 1:
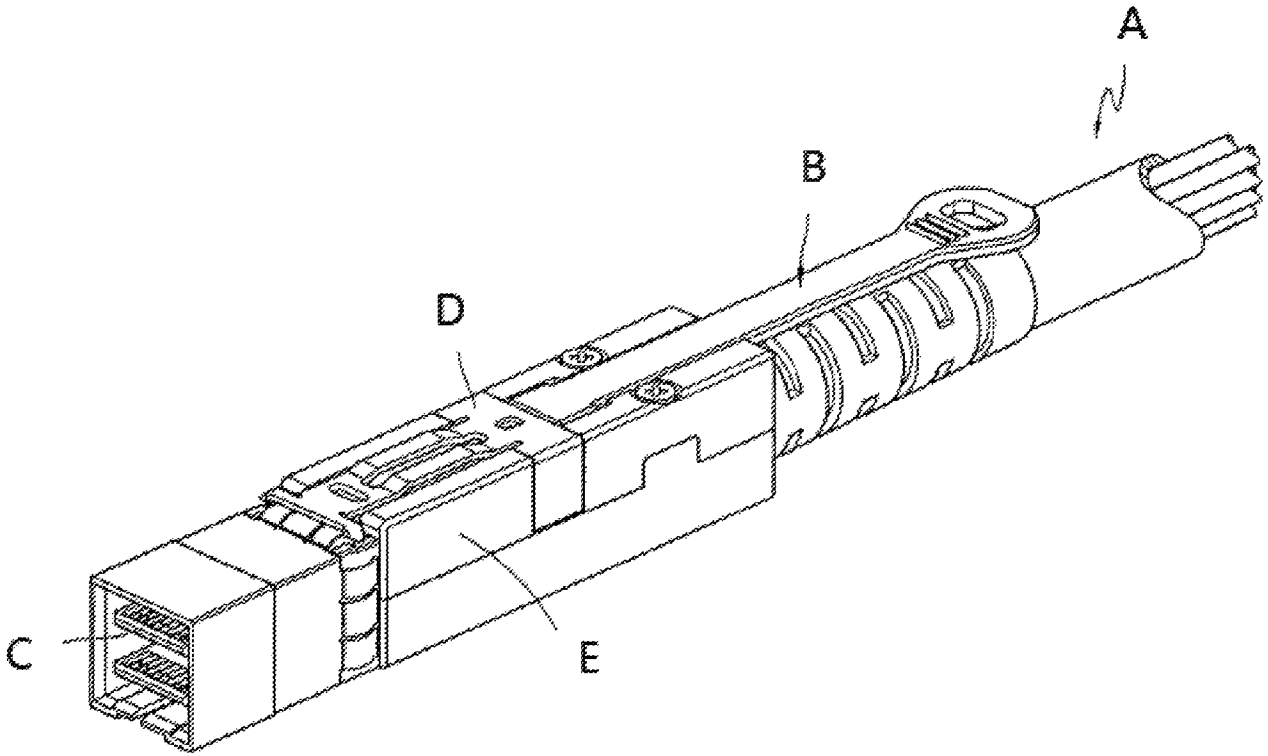
FIG. 1 (Prior Art)
FIG. 1 illustrates a perspective view of a conventional electrical connector assembly disclosed in Taiwanese Patent Serial Number M485551.
Figure 2:
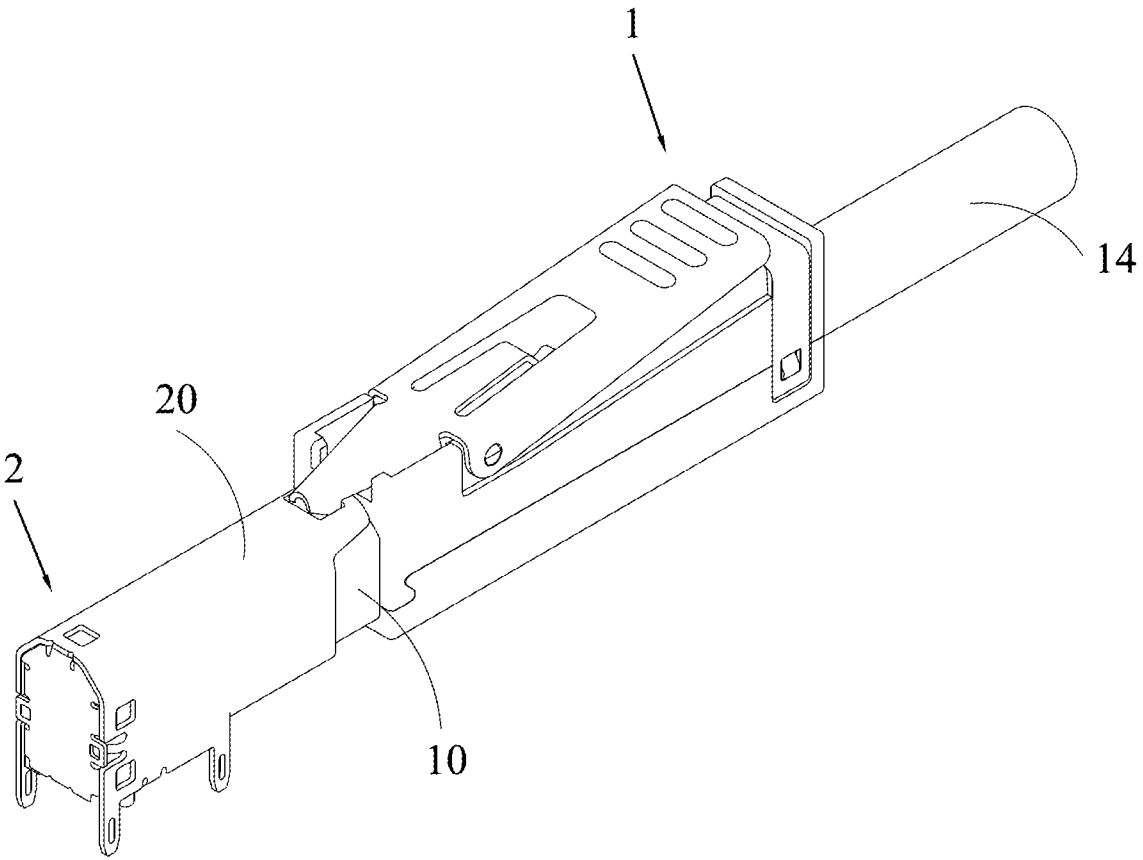
FIG. 2 illustrates a perspective view of an electrical connector assembly according to an embodiment of this invention.
Figure 3:
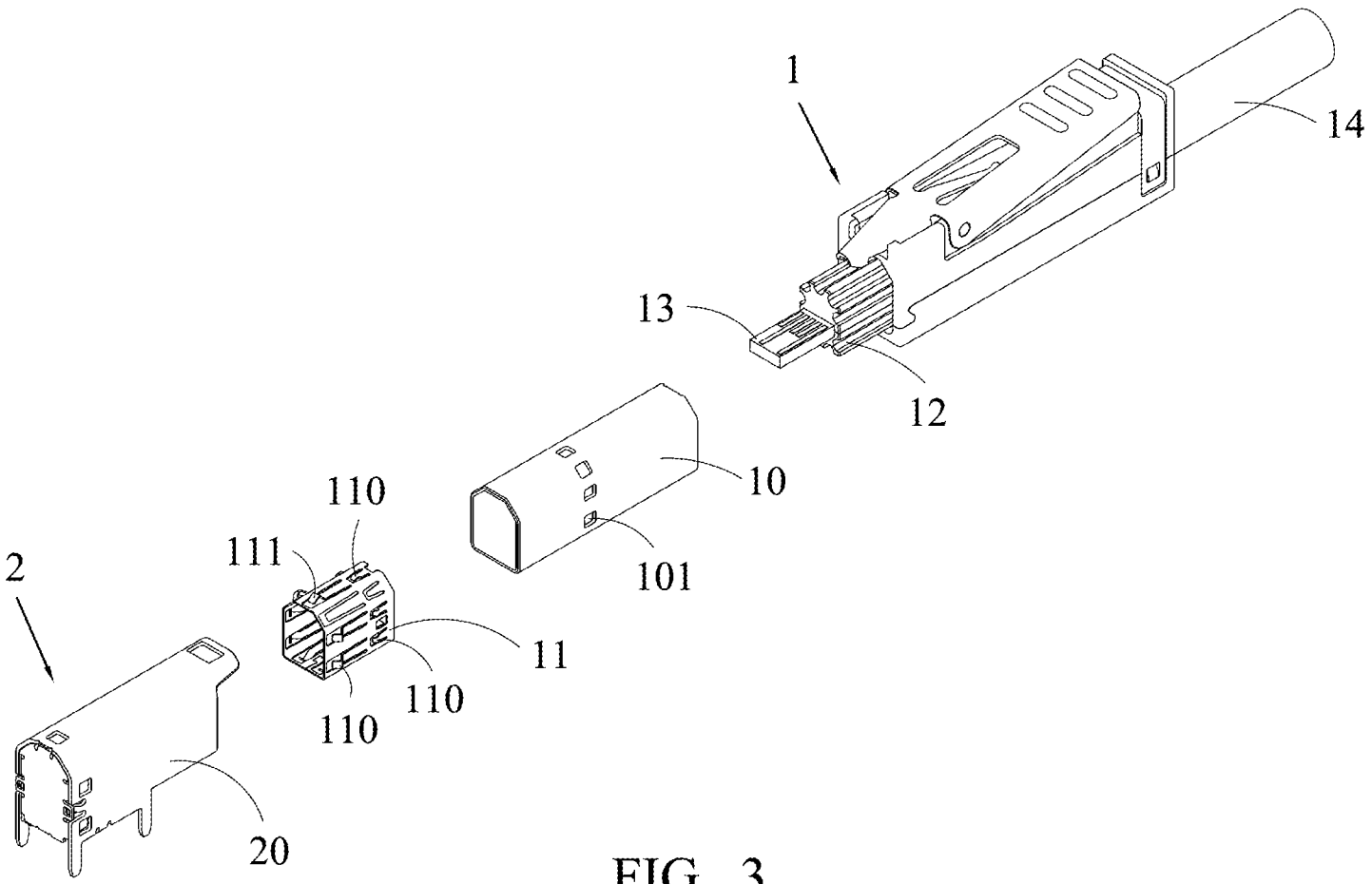
FIG. 3 illustrates a perspective view of the electrical connector assembly in FIG. 2 where the first shielding housing and shielding member are detached from the plug connector.
Figure 4:
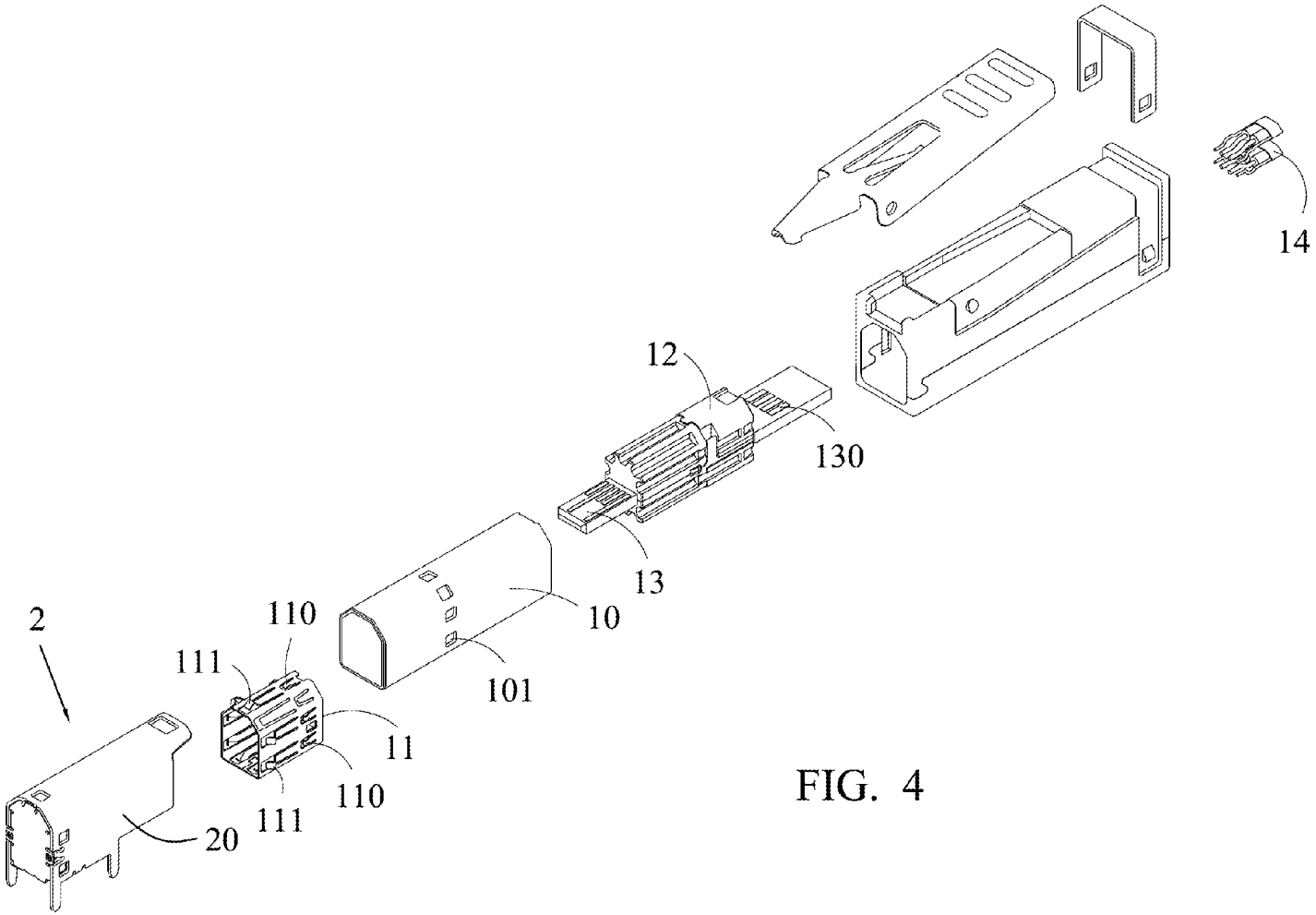
FIG. 4 illustrates an exploded view of the electrical connector assembly in FIG. 2.
Figure 5:
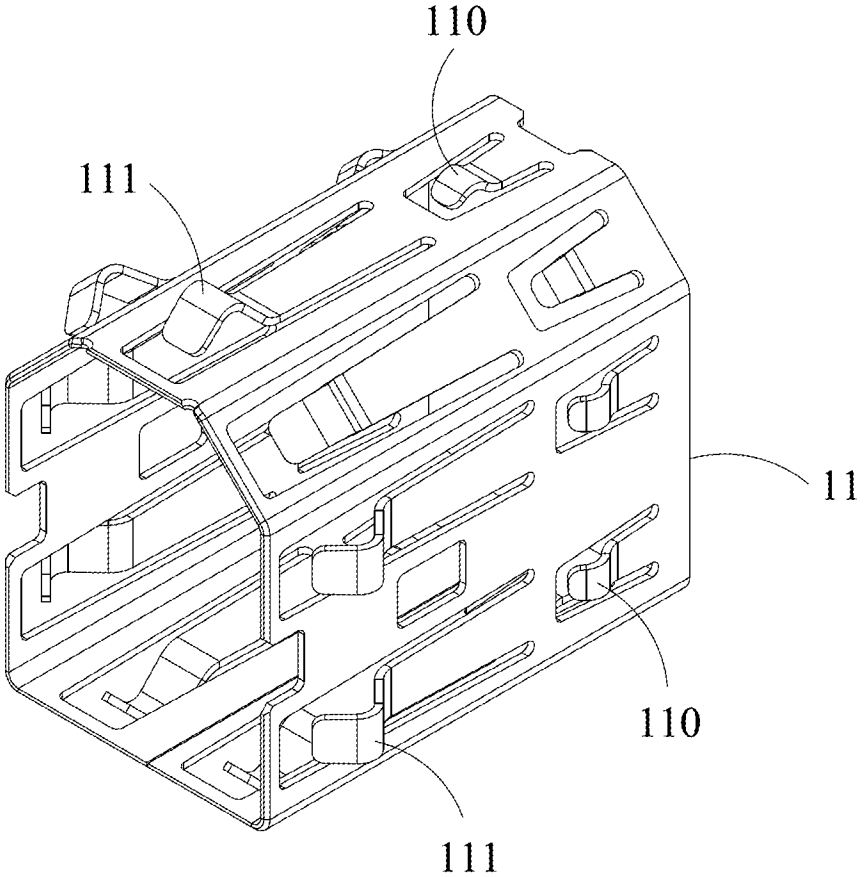
FIG. 5 illustrates an enlarged view of the shielding member in FIG. 3 or FIG. 4.

Reference will now be made in detail to the present embodiments of the disclosure, examples of which are illustrated in the accompanying drawings. Wherever possible, the same reference numbers are used in the drawings and the description to refer to the same or like parts.

Figure 6:
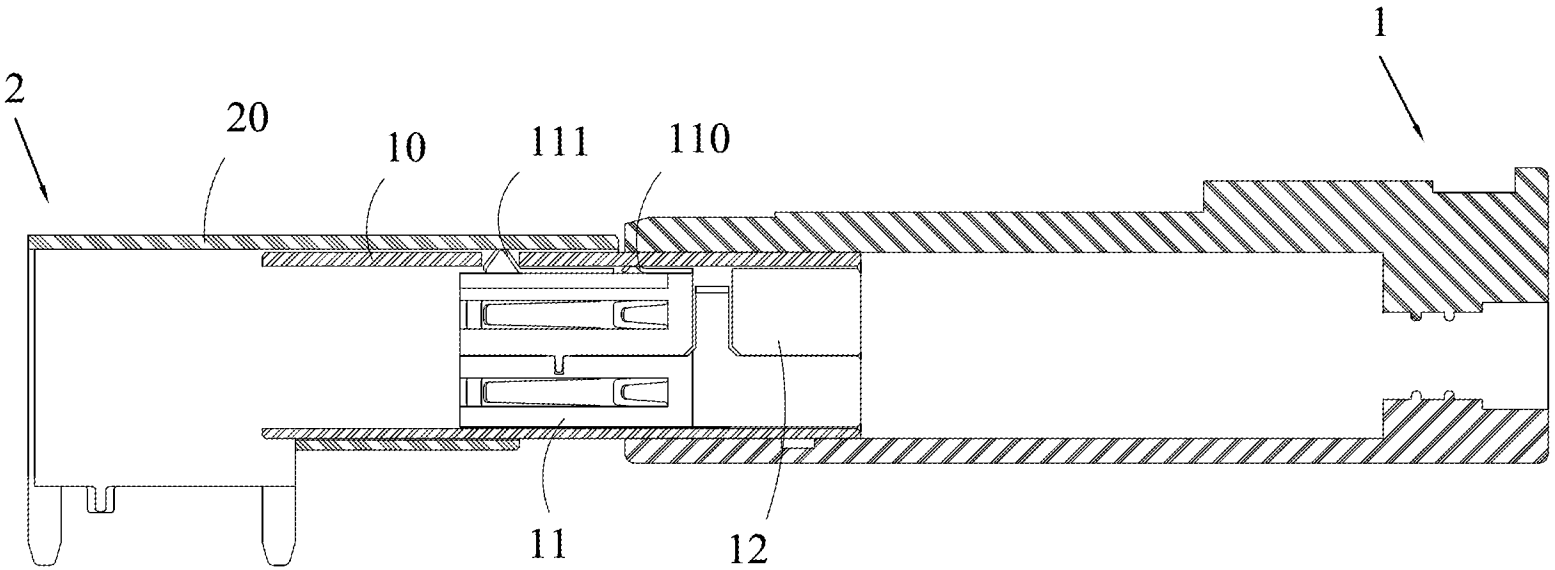
FIG. 6 illustrates a cross-sectional view of an electrical connector assembly (when the socket connector and the plug connector are interconnected) according to an embodiment of this invention.
Figure 7:
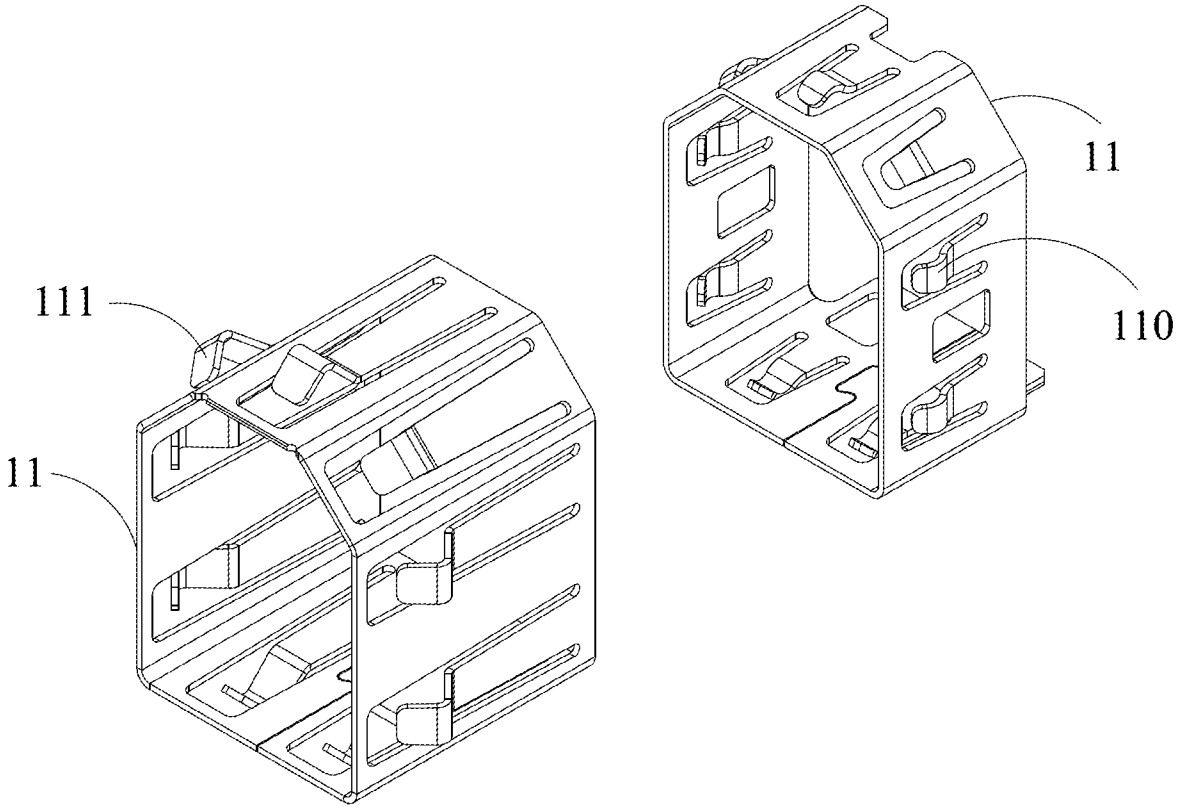
FIG. 7 illustrates a perspective view of a shielding member in two parts according to another embodiment of this invention.
Figure 8:
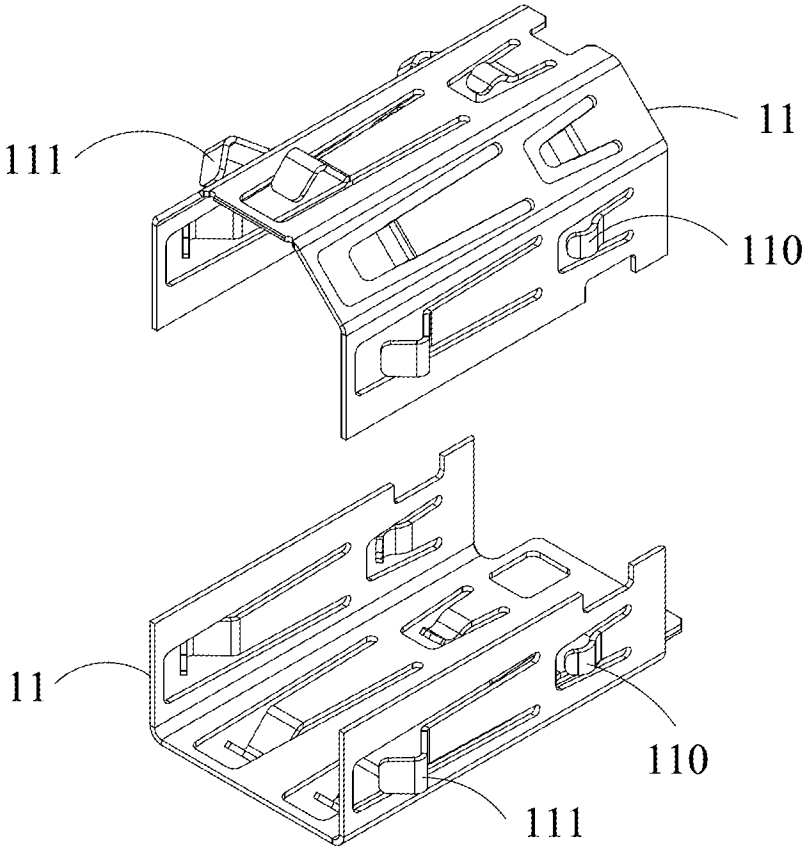
FIG. 8 illustrates a perspective view of a shielding member in two parts according to still another embodiment of this invention.

Referring to FIGS. 2-9, which illustrate an electrical connector assembly according to embodiments of this invention. The electrical connector assembly includes a plug connector 1 and a socket connector 2. The plug connector 1 has an insulator body 12, a first shielding housing 10 and a shielding member 11. The first shielding housing 10 encloses the insulator body 12 within its inside hollow space. In this embodiment, the shielding member 11 is a hollow metal frame made from a bent (thin) metal sheet. In actual practice, the shielding member 11 may consist of multiple sub-shielding members assembled as a whole piece. For example, the shielding member 11 may consist of a front-half sub-shielding member and a back-half sub-shielding member to be assembled as a whole piece (as illustrated in FIG. 7). Similarly, the shielding member 11 may consist of an upper-half sub-shielding member and a lower-half sub-shielding member to be assembled as a whole piece (as illustrated in FIG. 8). The assembly method may be implemented by a conventional welding or other compatible ways, e.g., latching or engaging. The shielding member 11 is designed to have multiple first contact portions 110 and multiple second contact portions 111. The first contact portions 110 are configured to achieve electrical connection with the first shielding housing 10 (i.e., in contact with an inner surface of the first shielding housing 10 as illustrated in FIG. 6). When the socket connector 2 and the plug connector 1 are interconnected, the second contact portions 111 are configured to achieve electrical connection with a second shielding housing 20 of the socket connector 2.

In one or more embodiments of the electrical connector assembly disclosed herein, the plug connector 1 has a signal-transmitting module 13 and a cable 14, wherein the signal-transmitting module 13 is equipped with multiple electrical terminals 130 and embedded within the insulator body 12. The insulator body 12 is located between the signal-transmitting module 13 and the first shielding housing 10 to achieve electrical isolation, and the electrical terminals 130 of the signal-transmitting module 13 are electrically connected with the cable 14. In this embodiment, the signal-transmitting module 13 may be a (printed) circuit board or other metallic conductors, e.g., conductive terminals. The shielding member 11 is secured to the insulator body 12, and located between the first shielding housing 10 and the signal-transmitting module 13. The first shielding housing 10 is designed with multiple through holes 101 allowing the second contact portions 111 of the shielding member 11 to protrude out of corresponding ones.

Figure 9:
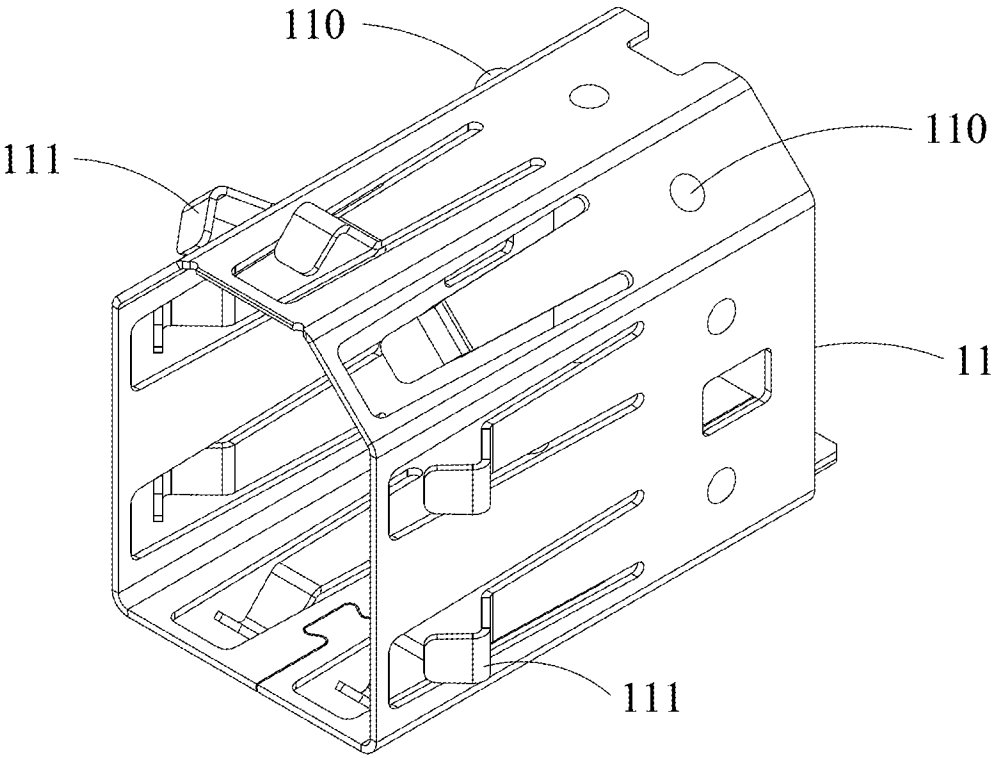
FIG. 9 illustrates a perspective view of a shielding member as one single piece according to still another embodiment of this invention.

In one or more embodiments of the electrical connector assembly disclosed herein, the shielding member 11 is made from a bent (thin) metal sheet, and its first contact portions 110 and second contact portions 111 are projected outwards away from the signal-transmitting module 13, part of which is embedded within the insulator body 12. In this embodiment, the first contact portions 110 and the second contact portions 111 both can be resilient arms, but may also be implemented by non-resilient materials. Referring to FIG. 9, the first contact portions 110 of the shielding member 11 are implemented as protrusion bumps, and are electrically connected with the first shielding housing 10 when the shielding member 11 is installed within the plug connector 1. In this embodiment, the cable 14 includes multiple core wires to be electrically connected with the electrical terminals 130 of the signal-transmitting module 13. When the plug connector 1 is interconnected with the socket connector 2, a signal terminal (not illustrated in drawings) of the socket connector 2 is electrically connected with the signal-transmitting module 13 of the plug connector 1 such that the cable 14 is electrically connected with the signal terminal of the socket connector 2 via the signal-transmitting module 13. When the socket connector 2 is interconnected with the plug connector 1, the second shielding housing 20 is electrically connected with the second contact portions 111 of the shielding member 11.

The second shielding housing 20 is the outermost part of the socket connector 2, the shielding member 11 encloses the insulator body 12, and the first shielding housing 10 also encloses the insulator body 12, the shielding member 11 and part of the signal-transmitting module 13. With this regard, the first shielding housing 10 and the second shielding housing 20 can isolate EMI cross talks when the plug connector 1 is interconnected with the socket connector 2. Since grounding the high-frequency electromagnetic waves is an effective strategy to suppress electromagnetic noises, the second shielding housing 20 is in contact with the second contact portions 111, which protrude out of the through holes 101 of the first shielding housing 10 to achieve an electrical connection when the plug connector 1 is interconnected with the socket connector 2 (referring to FIG. 6). Therefore, EMI cross talks between inner signals and outer signals of the plug connector 1 and socket connector 2 assembly can be isolated, and the shielding member 11 is also grounded when it is in contact with second shielding housing 20.

With the electrical connector assembly designed as such, the first shielding housing 10, the shielding member 11 and the second shielding housing 20 can effectively suppress electromagnetic noises when the signal is transmitted. In addition, the detached mechanism between the plug connector 1 and socket connector 2 is designed to be simpler to enhance assembling efficiency such that the assembly process can be easier to increase productivity and improve the complex, cumbersome and costly shortcomings of the traditional process.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. An electrical connector assembly comprising:

a plug connector comprising an insulator body, a first shielding housing and a shielding member, wherein the first shielding housing encloses the insulator body, the shielding member has first contact portions and second contact portions, and the first contact portions are electrically connected with the first shielding housing; and a socket connector configured to be electrically connected with the plug connector, and the socket connector has a second shielding housing configured to be electrically connected with the second contact portions.

2. The electrical connector assembly of claim 1, wherein the plug connector has a signal-transmitting module, part of which is embedded within the insulator body, and the insulator body is disposed between the signal-transmitting module and the first shielding housing to achieve electrical isolation.

3. The electrical connector assembly of claim 2, wherein the shielding member secured to the insulator body, and the shielding member is disposed between the first shielding housing and the signal-transmitting module, the first shielding housing has through holes configured to allow the second contact portions of the shielding member to protrude out.

4. The electrical connector assembly of claim 1, wherein the shielding member is made from a bent metal sheet.

5. The electrical connector assembly of claim 1, wherein the shielding member consists of multiple assembled sub-shielding members.

6. The electrical connector assembly of claim 1, wherein the shielding member is a hollow metal frame.

7. The electrical connector assembly of claim 1, wherein the first contact portions are resilient arms.

8. The electrical connector assembly of claim 1, wherein the first contact portions are protrusion bumps.

9. The electrical connector assembly of claim 1, wherein the second contact portions are resilient arms.

* * * * *